US007864924B2

(12) United States Patent
Ziskin et al.

(10) Patent No.: US 7,864,924 B2
(45) Date of Patent: Jan. 4, 2011

(54) SCANNING X-RAY RADIATION

(75) Inventors: Vitaliy Ziskin, Brighton, MA (US); Boris Oreper, Newton, MA (US); Andrew Dean Foland, Cambridge, MA (US)

(73) Assignee: L-3 Communications Security and Detection Systems, Inc., Woburn, MA (US)

( * ) Notice: Subject to any disclaimer, the term of this patent is extended or adjusted under 35 U.S.C. 154(b) by 0 days.

(21) Appl. No.: 12/138,668

(22) Filed: Jun. 13, 2008

(65) Prior Publication Data

US 2008/0310594 A1 Dec. 18, 2008

Related U.S. Application Data

(60) Provisional application No. 60/943,640, filed on Jun. 13, 2007.

(51) Int. Cl.
*H01J 35/06* (2006.01)

(52) U.S. Cl. ..... 378/136; 378/119

(58) Field of Classification Search ..... 378/137, 378/122, 136, 119, 138, 143
See application file for complete search history.

(56) References Cited

U.S. PATENT DOCUMENTS

| | | | | |
|---|---|---|---|---|
| 3,983,397 | A | 9/1976 | Albert | |
| 4,606,061 | A | 8/1986 | Ramamurti | |
| 4,730,895 | A | 3/1988 | Siedband | |
| 5,042,058 | A | 8/1991 | Rentzepis | |
| 5,576,549 | A | 11/1996 | Hell et al. | |
| 5,680,431 | A | 10/1997 | Pietras | |
| 5,874,802 | A | 2/1999 | Choi | |
| 6,333,967 | B1 | 12/2001 | Osaka et al. | |
| 6,333,968 | B1 | 12/2001 | Witlock et al. | |
| 6,385,292 | B1 | 5/2002 | Dunham | |
| 6,516,048 | B2 | 2/2003 | Mori | |
| 6,885,138 | B1 | 4/2005 | Yoo | |
| 7,192,031 | B2 | 3/2007 | Dunham et al. | |
| 2005/0175151 | A1* | 8/2005 | Dunham et al. | 378/122 |
| 2006/0098783 | A1* | 5/2006 | Dunham et al. | 378/122 |

OTHER PUBLICATIONS

Lewellen, J.W. and Noonan, J., "Field-emission cathode gating for rf electron guns," *Physical Review Special Topics—Accelerators and Beams*, The American Physical Society, Mar. 23, 2005, pp. 033502-1-0330502-9.

Hommelhoff, P., et al., "Field Emission Tip as a Nanometer Source of Free Electron Femtosecond Pulses," *Physical Review Letters*, The American Physical Society, Feb. 21, 2006, pp. 077401-1-077401-4.

International Search Report and Written Opinion for International Application No. PCT/US08/66967, dated Aug. 11, 2008.

(Continued)

*Primary Examiner*—Hoon Song
(74) *Attorney, Agent, or Firm*—Fish & Richardson P.C.

(57) ABSTRACT

X-ray radiation is generated at a target that emits x-ray radiation in response to being struck by accelerated electrons, the electrons being emitted by a cathode that emits electrons in response to being illuminated by electromagnetic radiation from a source, and the x-ray radiation is moved by orienting a surface that directs the electromagnetic radiation from the source toward the cathode.

32 Claims, 10 Drawing Sheets

OTHER PUBLICATIONS

Moldonaldo, J.R., et al., "Cs Halide Photocathode for Multi-Electron-Beam Pattern Generator," *J. Vac. Sci. Technol.* B 22(6), Nov./Dec. 2004, pp. 3025-3031.

Yang, J., et al., "Experimental Studies of Photocathode RF Gun with Laser Pulse Shaping," reprinted from http://www-ssrl.slac.stanford.edu/lcls/papers/tupri075.pdf on Sep. 8, 2010, 3 pages.

Burrill, Andrew, "BNL Photocathode R&D: An Overview of Research on High Quantum Efficiency Photocathodes and Associated Laser Systems," HPHB Workshop, Nov. 9, 2004, Brookhaven National Laboratory, 15 pages.

"GaAs Photocathode Performance," Thomas Jefferson National Accelerator Facility, reprinted from http://home.physics.ucla.edu/calendar/conferences/powerworkshop/presentations/WG-C/jlab_gun_injector.pdf on Sep. 8, 2010, 7 pages.

* cited by examiner

200

SCANNING X-RAY RADIATION

CROSS-REFERENCE TO RELATED APPLICATIONS

This application claims the benefit of U.S. Provisional Application No. 60/943,640, titled L-BEAM, and filed on Jun. 13, 2007, which is incorporated herein by reference in its entirety.

TECHNICAL FIELD

This description relates to generating scanning x-ray radiation.

BACKGROUND

X-ray beams may be produced by striking a target with an electron beam. The resulting x-rays may illuminate a sample.

SUMMARY

In one general aspect, a system includes a source that emits electromagnetic radiation, and a cathode that emits electrons in response to being illuminated by the electromagnetic radiation. An accelerating element accelerates the emitted electrons from the cathode toward a target that generates localized x-ray radiation in response to being struck by the accelerated electrons. The system also includes a surface that directs the electromagnetic radiation from the source toward the cathode, and a mechanism coupled to the surface that moves the electromagnetic radiation emitted from the source relative to the cathode such that a position of the localized x-ray radiation corresponds to a position of the electromagnetic radiation emitted from the source.

Implementations may include one or more of the following features. The surface that directs the electromagnetic radiation from the source toward the cathode may be a reflective element configured to reflect the electromagnetic radiation emitted from the source toward a portion of the cathode determined by an orientation of the reflective element, and the mechanism coupled to the surface may be an actuator coupled to the reflective element that controls the orientation of the reflective element. The reflective element may include a reflective surface, and the actuator may be a voltage at the reflective surface. The reflective element may include a reflective surface, and the actuator may include a movable mounting device that controls the orientation of the reflective surface. The reflective element may be a mirror.

A vacuum chamber may enclose the cathode and the target, a first window may transmit the electromagnetic radiation emitted from the source into the vacuum chamber, and a second window may transmit the localized x-ray radiation from the vacuum chamber. The source that emits electromagnetic radiation may be a laser. The source that emits electromagnetic radiation may be an incandescent source. The cathode may include more than one cathode arranged in a linear array along a track. The track may be a flat surface. The cathode may be a transmission cathode. The cathode may emit electrons in response to being illuminated by electromagnetic radiation included in a band of wavelengths, and applying a voltage to the cathode may determine the band of wavelengths. The system may include a detector. The accelerating element may be a potential between the cathode and the target, the potential may be relatively greater at the target as compared to the cathode. The accelerating element may include multiple potentials between the cathode and the target. The cathode may be a photocathode.

In another general aspect, x-ray radiation is generated at a target that emits x-ray radiation in response to being struck by accelerated electrons, the electrons being emitted by a cathode that emits electrons in response to being illuminated by electromagnetic radiation from a source, and the x-ray radiation is moved by orienting a surface that directs the electromagnetic radiation from the source toward the cathode.

Implementations may include one or more of the following features. Moving the x-ray radiation by orienting a surface that directs the electromagnetic radiation from the source toward the cathode may include directing the electromagnetic radiation from the source toward a reflective surface and rotating the reflective surface such that the electromagnetic radiation moves with respect to the cathode. A voltage may determine an orientation of the reflective surface. The source may be moved relative to the cathode. A sample may be illuminated with the x-ray radiation, x-ray radiation transmitted by the sample may be detected, and an image of the sample based on the detected x-ray radiation may be generated.

In another general aspect, a system includes an array of sources that emit incoherent light, the sources in the array being configured to be selectively activated to emit the light, a cathode that emits electrons in response to being illuminated by light emitted from an activated source included in the array, and an accelerating element that accelerates the emitted electrons toward a target that generates x-ray radiation in response to being struck by the accelerated electrons, the x-ray radiation having a location relative to the target that is determined by a position of the activated source.

Implementations may include one or more of the following features. The array of sources may include multiple incandescent light sources. The array may be a linear array. The incoherent light may be broadband incoherent light.

In another general aspect, incoherent light sources to activate are selected, the incoherent light sources being selected from among multiple incoherent light sources positioned relative to one another in an array of sources, and the selected light sources are activated. A cathode is illuminated with light emitted from the activated light sources, and accelerating electrons emitted from the cathode toward a target that emits x-ray radiation in response to being struck by the emitted electrons, the emitted x-ray radiation having a position relative to the cathode and the target that is determined by a position of the activated light sources within the array.

Implementations of any of the techniques described above may include a method, a process, a system, a device, an apparatus, or instructions stored on a computer-readable medium. The details of one or more implementations are set forth in the accompanying drawings and the description below. Other features will be apparent from the description and drawings, and from the claims.

DETAILED DESCRIPTION

Figure 1:
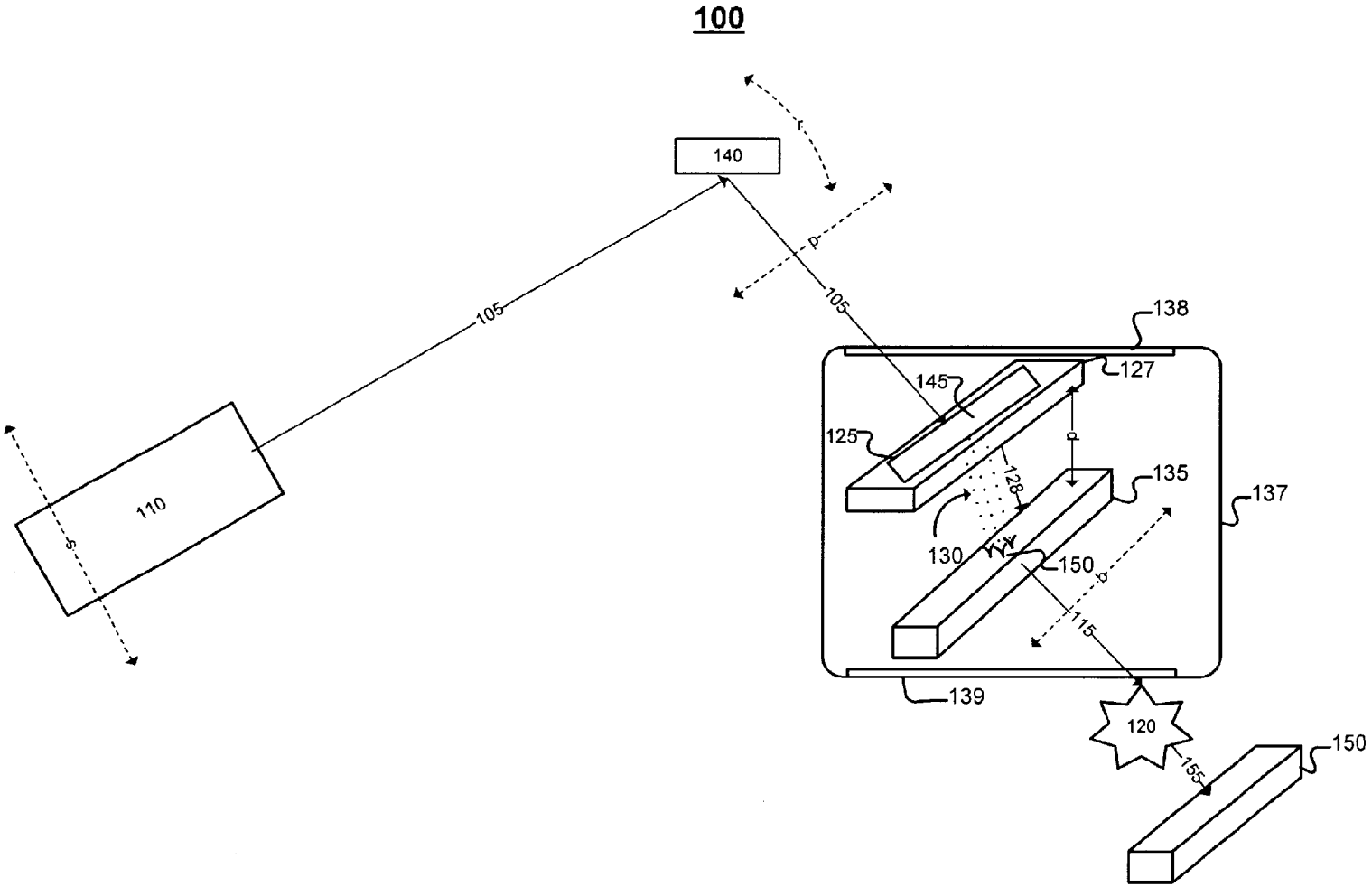
FIGS. 1, 2A, 4A-4C, 5, 7A-7C, and 8 illustrate example systems for scanning an x-ray beam.

FIG. 1 illustrates an example system 100 that generates an x-ray beam 115. The x-ray beam 115 moves along a path "b"

in response to electromagnetic radiation 105 being scanned along a path "p." The electromagnetic radiation 105 may be moved by moving a source 110 from which the electromagnetic radiation 105 is emitted and/or by steering the electromagnetic radiation 105 using a reflective element 140. In particular, changing the position of the electromagnetic radiation 105 relative to a cathode 125 results in a corresponding change in the position of the x-ray radiation 115 such that moving the electromagnetic radiation 105 results in moving the x-ray radiation 115. Thus, moving the electromagnetic radiation 105 causes the x-ray radiation 115 to move such that the x-ray radiation 115 can be used to scan a sample 120 to, for example, generate an image of the sample 120. The electromagnetic radiation 105 may be light, and the source 110 may be any source of electromagnetic radiation. For example, the source 110 may be a laser, a light-emitting diode, or a non-laser light source (such as an incandescent bulb).

As discussed in more detail below, interaction between the electromagnetic radiation 105 and a cathode 125 produces an electron beam 130. The cathode 125 is a material that emits electrons in response to illumination and/or stimulation by electromagnetic radiation having sufficient energy at wavelengths within a sensitive region of the cathode material. For example, the cathode may be a photocathode that emits electrons in response to being stimulated by light. In a second example, the cathode may be a field emission tip or a collection of tips where the electrons are emitted due to high electric field gradient and the emission is stimulated by electromagnetic radiation. The electron beam 130 strikes a target 135, and the interaction of the electron beam 130 and the target 135 produces the x-ray radiation 115. The x-ray radiation 115 also may be referred to as an x-ray beam spot or an x-ray beam. By directing the electromagnetic radiation 115 to illuminate different portions of the cathode 125, the x-ray radiation 115 may be moved along the sample 120 for the purposes of, for example, computerized tomography (CT) image reconstruction. Thus, an imaging technique is contemplated that involves both generation of the electron beam 130 by interaction between the electromagnetic radiation 105 and the cathode 125 and scanning of the x-ray radiation 115 along the sample 120. The sample 120 may be, for example, a piece of luggage to be examined for the presence of threats such as explosives or other hazardous materials. For example, the sample 120 may be an item of manufacture to be examined for defects such as microscopic cracks. In another example, the sample 120 may be biological tissue to be examined for the presence of disease.

In contrast to techniques in which a moving x-ray beam is created by steering an electron beam such that the electron beam scans a high-atomic number target that produces x-rays, the system 100 employs a technique of steering the electromagnetic radiation 105. Steering the electromagnetic radiation 105 instead of directly steering the electron beam 130 may help to decrease, perhaps, significantly decrease, the size of a scanning X-ray tube while producing CT reconstruction images of comparable quality to a conventional sized scanning X-ray tube. For example, the cathode 125 is located a distance "d" from the target 135. In some implementations, the distance "d" is about 10 centimeters (cm). In other implementations, the distance "d" is between about 1 cm to 1 meter (m). Both a track 127, which includes the cathode 125, and the target 135 are enclosed in a vacuum chamber 137. However, because the cathode 125 and the target 135 are located relatively close together, the size of the vacuum chamber 137 may be smaller than the vacuum tubes used in techniques that include steering an electron beam. Additionally, as discussed above, the source 110 may be a laser or other light source, and the source 110 may be commercially available, which may help reduce the cost and complexity of the system 100. Moreover, the electromagnetic radiation 105 emitted from the source 110 may be swept quickly across the track 127 (e.g., 1000 times per second or more) by rotating the reflective element 140, and/or by moving the source 110. Because the x-ray radiation 115 is also swept at substantially the same speed at which the electromagnetic radiation is swept, the x-ray radiation 115 generated by the system 100 may be rapidly scanned over the sample 120.

In greater detail, the electromagnetic radiation 105 emitted from the source 110 is reflected from the reflective element 140, enters the vacuum chamber 137 through a quartz window 138, and illuminates the cathode 125. The cathode 125 interacts with the electromagnetic radiation 105, and, when the electromagnetic radiation 105 has sufficient energy within the sensitive region of the cathode 125, the interaction produces electrons. In the example shown in FIG. 1, the cathode 125 is a single piece of material. However, in other examples (such as the example discussed below with respect to FIG. 2A), the cathode 125 includes multiple discrete cathode cells that are positioned in an array along a track such as the track 127.

In the example shown in FIG. 1, a portion 145 of the cathode 125 is illuminated by the electromagnetic radiation 105. The interaction of the cathode 125 with the electromagnetic radiation 105 produces the electron beam 130 is produced in the vicinity of the portion 145. The target 135 is biased at a greater voltage relative to the cathode 125, thus a difference in potential (which also may be referred to as a voltage gap) exists between the cathode 125 and the target 135. The electrons in the electron beam 130 emitted from the cathode 125 are accelerated through the distance "d" by an accelerating element (such as the voltage gap) and toward the target 135. In some implementations, the accelerating element may include multiple accelerating elements and the accelerating elements may collectively be referred to as a grid. The multiple accelerating elements may be potentials located between the cathode 125 and the target 135. The potentials may be elements, such as electrodes, that are held at various potentials with respect to the potential of the cathode 125. For example, the multiple accelerating elements may have a higher potential than the cathode 125 and the potentials may be oriented such that the potentials focus the electron beam 130 as the electron beam is accelerated toward the target 135. In a second example, the multiple accelerating elements may have a negative potential with respect to the cathode 125. In this example, activating the multiple accelerating elements prevents the electron beam 130 from reaching the target 135. The multiple accelerating elements may each have different potentials relative to each other and relative to the cathode 125. For example, some of the multiple accelerating elements may have a potential that is less than that of the cathode 125 while others of the multiple accelerating elements may have a potential that is greater than the potential of the cathode 125.

As discussed above, the distance "d" is the distance between the cathode 125 and the target 135. The distance "d" may be, for example, between 1 cm and 1 m, and the value of the distance "d" is determined by the system parameters such as the magnitude of the voltage gap between the cathode 125 and the target 135. For example, the electron beam 130 may diverge as the electron beam 130 propagates from the cathode 125 to the target 135. Thus, increasing the value of "d" may result in a corresponding increase in a size of an electron beam spot on the target 125, and smaller values of "d" may help to reduce the size electron beam spot on the target 125. A smaller electron beam spot may deliver more electrons per unit area to the target 135, and a smaller electron beam spot may result in better image reconstruction. However, as the distance "d" is reduced, arcing may occur as the cathode 125 and the target 135 come closer together. Thus, the distance "d" may be selected such that the distance "d" between the cathode 125 and the target 135 is as small as possible without arcing occurring between the cathode 125 and the target 135. Because arcing occurs more readily as the magnitude of the voltage gap between the cathode 125 and the target 135 increases, the lower bound on the distance "d" depends on the magnitude of the voltage gap between the cathode 125 and the target 135.

The x-ray radiation 115 is generated in response to the electrons in the electron beam 130 striking the target 135. The x-ray radiation 115 may be emitted from the target 135 in any direction, and the emitted x-ray radiation may be collimated in the direction of the sample 120. The target 135 may be any material that produces x-ray radiation when struck by electrons. For example, the target 135 may be a dense, thermally conductive material with a high atomic number, such as rheniated tungsten, tungsten, copper, molybdenum, or rhenium.

The x-ray radiation 115 is localized with respect to the target 135 such that the generated x-ray radiation 115 has a position in the vicinity of the position along the target 135 where the electron beam 130 struck. The position along the target 135 that the electron beam 130 strikes is determined by the portion of the cathode 125 that is illuminated by the electromagnetic radiation 105. In the example shown in FIG. 1, a reflective element 140 steers the electromagnetic radiation 105 such that the portion 145 of the cathode 125 is illuminated. The electron beam 130 is generated in the vicinity of the portion 145 of the cathode 125 and the electron beam 130 strikes a corresponding portion 150 of the target 135. The x-ray radiation 115 is generated in the vicinity of the portion 150. Thus, the position of the electromagnetic radiation 105 relative to the cathode 125 ultimately determines the position of the x-ray radiation 115, and positioning or scanning the electromagnetic radiation 105 allows the x-ray radiation 115 to be correspondingly positioned or scanned.

In the example shown in FIG. 1, the electromagnetic radiation 105 may be positioned or scanned by rotating the reflective element 140 along the path "r." Rotating the reflective element 140 along the path "r" moves the electromagnetic radiation 105 along the path "p" such that the electromagnetic radiation may be scanned along the cathode 125, which causes the x-ray radiation 115 to be scanned along the path "b." Alternatively or additionally, the electromagnetic radiation 105 may be moved by moving the source 110 along a path "S."

The x-ray radiation 115 passes through a window 139 and illuminates a sample 120, and transmitted x-ray radiation 155 is sensed by a detector 150. The window 139 may be made from any material that transmits the energies present in the x-ray radiation 115. For example, the window 138 may be made from beryllium, aluminum, or a thin sheet of steel. The transmitted x-ray radiation may be used to create an image of the sample 120.

Figure 2A:
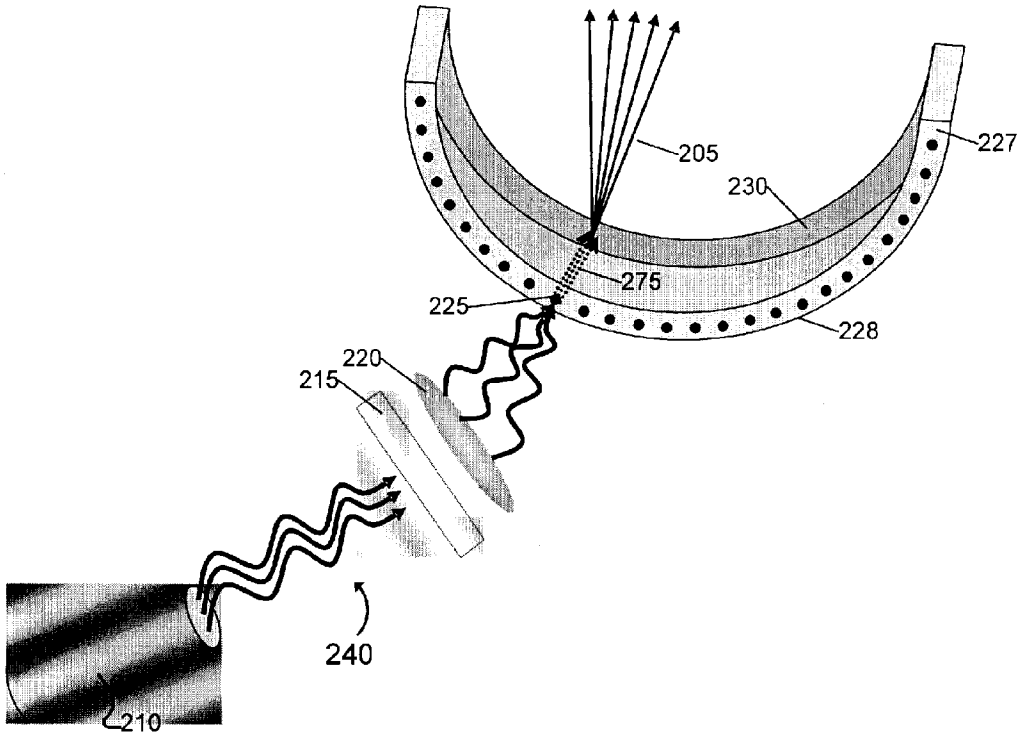

Referring to FIG. 2A, an example system 200 for generating a scanning x-ray beam 205 by scanning electromagnetic radiation 240 emitted from a source 210 is illustrated. The system 200 includes a source 210, a reflective element 215, a lens 220, cathode 225 arranged on a track 227, and a target 230. The cathode 225 and the target 230 are enclosed in a vacuum chamber (not shown). The source 210 emits electromagnetic radiation 240 that is directed toward the reflective element 215. The electromagnetic radiation 240 may be directed toward the reflective element 215 by, for example, propagation through free space, a system of lenses, and/or an optical fiber. The source 210 may be, for example, a laser, a light emitting diode, a broadband incoherent source such as an incandescent lamp, or any other source of electromagnetic radiation that includes radiation having wavelengths within a sensitive region of the cathode 225 (e.g., radiation having wavelengths that interact with the cathode to produce electrons) and sufficient energy to produce electrons from the interaction between the radiation and the cathode 225. In some implementations, the source 210 may be a light emitting diode having a wavelength of about 500 nanometers (nm) and a power of between 10-100 Watts (W). However, other implementations may use a source that emits electromagnetic radiation of a higher or lower wavelength at a different power. In some implementations, a non-laser source may be used as the source 210. For example, the source 210 may be an incoherent, broadband source such as an incandescent lamp. In this example, the source 210 produces electromagnetic radiation over a broad range of wavelengths that includes wavelengths within the sensitive region of the cathode 225.

Figure 2C:
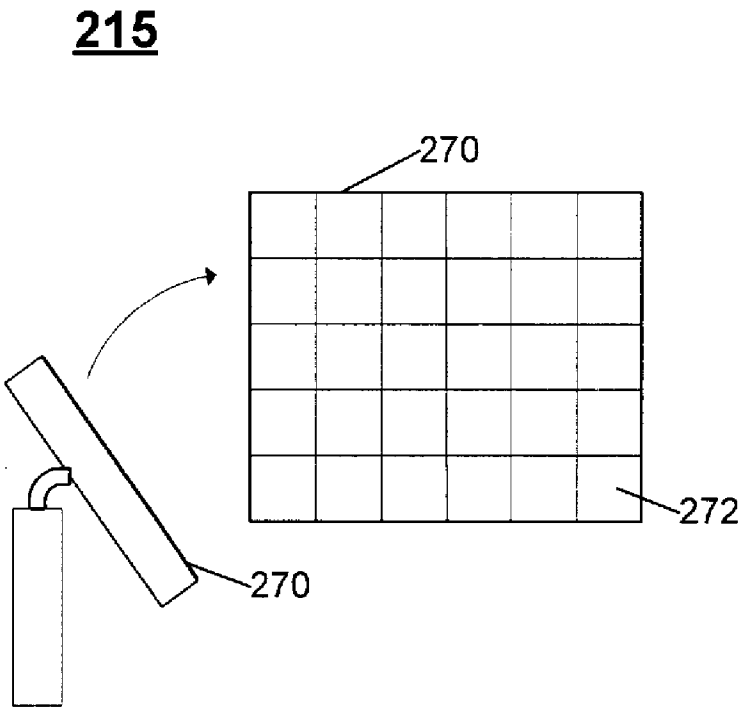
FIGS. 2B and 2C illustrate example reflective elements.
Figure 2B:
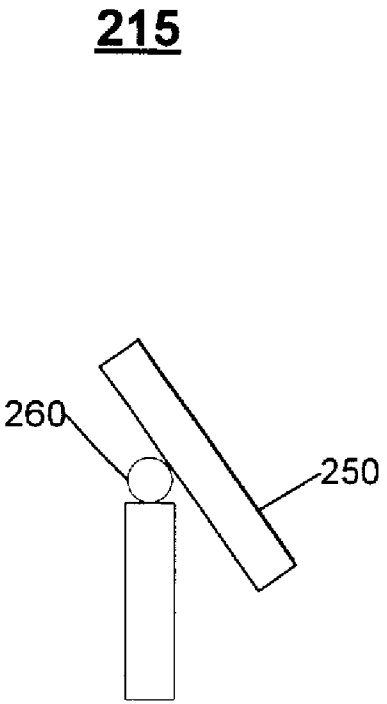

The electromagnetic radiation 240 is directed toward the reflective element 215 as discussed above. The reflective element 215 scans the electromagnetic radiation 240 along the cathode 225. The reflective element 215 may be any element that alters the path of the electromagnetic radiation 240 such that the electromagnetic radiation 240 may be scanned along the cathode 240. For example, the reflective element 240 may be a mirror, a diffraction grating, a beam splitter, or a prism. Referring to FIGS. 2B and 2C, examples of the reflective element 215 are shown. In the example shown in FIG. 2B, the reflective element 215 includes a reflective surface 250 and the reflective element 215 is positioned on a mechanical mount 260 that positions the reflective surface 250 such that the electromagnetic radiation 240 is directed toward a particular portion of the cathode 225. The reflective surface 250 may be any type of surface that can alter the propagation path of the electromagnetic radiation 240. For example, the reflective surface may be a mirror. The mechanical mount 260 may be driven by a motor that includes a wheel coupled to the reflective element 215. The motor moves the wheel to change the orientation of the reflective element 215. Use of the motor may allow rapid positioning of the reflective surface 250. In other examples, the mechanical mount 260 may be configured to allow for manual adjustment of the reflective surface 250 in addition to, or instead of, motor control.

Referring to FIG. 2C, an additional example of a reflective element 215 is shown. In this example, the reflective element 215 has a reflective surface 270, and an orientation of the reflective surface 270 is determined by a voltage associated with the reflective surface 270. For example, a portion 272 of the reflective surface 270 moves in response to a voltage associated with the portion 272. Although one portion 272 is discussed with respect to the example of FIG. 2C, the reflective surface 270 may have additional portions, and the orientation of each of the additional portions may be individually controllable. For example, the reflective element 215 may be a MEMS device, such as a DLP® available from Texas Instruments Incorporated of Delaware. Controlling the position of the reflective surface 270 by voltage may result in faster positioning of the reflective surface 270 as compared to techniques that use mechanical positioning. Thus, as compared to the mechanical mount 260, controlling the position of the reflective surface with a voltage may allow more rapid scanning of the electromagnetic radiation 240 across the cathode 225, which generates a more rapidly moving x-ray beam.

Referring again to FIG. 2A, the reflective element 215 directs the electromagnetic radiation 240 toward the cathode 225. In some examples, the lens 220 may move with the reflective element 215. In other examples, the lens 220 may be separate from the reflective element 215. For example, the lens 220 may be mounted on the cathode 225 such that the electromagnetic radiation 240 is focused onto the cathode 225. The electromagnetic radiation 240 is focused by the lens 220 onto the cathode 225. In some examples, the lens 220 focuses the electromagnetic radiation 240 to a 1-millimeter diameter spot on the cathode 225. Focusing the electromagnetic radiation 240 concentrates the energy in the electromagnetic radiation 240 and may produce greater amounts of electrons per unit area from the interaction between the electromagnetic radiation 240 and the cathode 225 as compared to illuminating the cathode 225 with unfocused electromagnetic radiation.

The cathode 225 may be an electrode that is coated with a photosensitive compound that releases electrons when the compound is illuminated by electromagnetic radiation that includes energy having wavelengths within the sensitive region of the photosensitive compound. The sensitive region of the cathode material may be shifted by applying a voltage, such as 1-10 kiloVolts (kV), to the cathode 225. Thus, the cathode 225 may be tailored to the spectral properties of the source 210 to maximize the amount of electrons produced by illuminating the cathode 225 with the electromagnetic radiation 240. Photosensitive compounds that may be used for the cathode 225 include, for example, bialkali, multialkali, gallium arsenide, and indium gallium arsenide. Bialkali photocathode has a sensitive region from about 300 nm to 1200 nm. Thus, in examples using a bialkali photocathode as the cathode 225, the cathode 225 emits electrons in response to being illuminated by electromagnetic radiation that includes sufficient radiation at wavelengths between 300 nm and 1200 nm. Depending on the light conversion efficiency of the cathode 225, sufficient radiation may be, for example, radiation greater than about 10 W or radiation between about 0.1 W to 100 W. The illumination of the cathode 225 to produce electrons may be determined based on a ratio of input power to the cathode 225 to efficiency of the cathode 225. In some implementations, an AC voltage may be applied to the cathode 225. Application of the AC voltage results in the electron beam 275 being a pulsed electron beam.

In the example shown in FIG. 2A, the cathode 225 is a transmission cathode (e.g., a cathode that emits electrons in the same general direction as the direction of propagation of the electromagnetic radiation 240 that illuminates the cathode). However, in other examples, the cathode 225 may be a reflection cathode (e.g., a cathode that emits electrons in a direction that is generally opposite of the direction of propagation of the electromagnetic radiation that illuminates the cathode). In the example shown in FIG. 2A, the track 227 includes discrete cathode cells, such as the cathode 225. However, in other examples, such as the example discussed above with respect to FIG. 1, the cathode may be a single cathode that covers all or part of the track 227.

In the example shown in FIG. 2A, the track 225 includes a curved surface 228, and the discrete cathode cells are arranged such that the cathodes follow the curved surface 228, and the discrete cathode cells are uniformly spaced with respect to each other along the curved surface 228. However, in other examples, such as the example discussed above with respect to FIG. 1, the track 225 includes a flat surface. Either arrangement of cathodes (e.g., discrete cathodes or a single cathode) may be used with a track having a flat or a curved surface. Additionally, in other examples, the single cathode or discrete cathode cells may be arranged in a two-dimensional pattern on a flat or curved surface. In examples having discrete cathode cells, the cathode cells may be uniformly spaced with respect to each other, such as the example shown in FIG. 2A, or the cathode cells may be non-uniformly distributed along the curved surface 228. In examples having discrete cathode cells, the applied voltage discussed above for shifting the sensitive region of the cathode and the AC voltage discussed above for producing a pulsed electron beam may be applied uniformly to all of the discrete cathode cells included in the track 227.

The electron beam 275 that is emitted from the cathode 225 in response to being illuminated by the focused electromagnetic radiation 240 is accelerated toward the target 230. The target 230 produces the x-ray radiation 205 in response to the accelerated electrons in the electron beam 275 colliding with other electrons, ions, and nuclei within the target 230. The x-ray radiation 205 is generated in a direction that is generally perpendicular to the path of the electron beam 275.

The target 230 may be made from a dense, thermally conductive material having a high atomic number such as rheniated tungsten, tungsten, molybendenum, copper, or gold. The electrons in the electron beam 275 are accelerated by a potential difference between the cathode 225 and the target 230. The potential difference may be referred to as a potential gap, and the potential difference is a difference between the potential of the cathode 225 and the potential of the target 230. The target 230 (which also may be referred to as an anode) has a greater potential with respect to the potential of the cathode 225. For example, in some implementations, the target 230 may be held at a potential of 180 kV. In some implementations, the target 230 may be held at a potential of between 50 kV and 220 kV. The voltage of the target 230 may determine the energy of the x-ray beam 205, thus, the voltage applied to the target 230 may be adjusted depending on the sample to be imaged or examined using the system 200.

Figure 3:
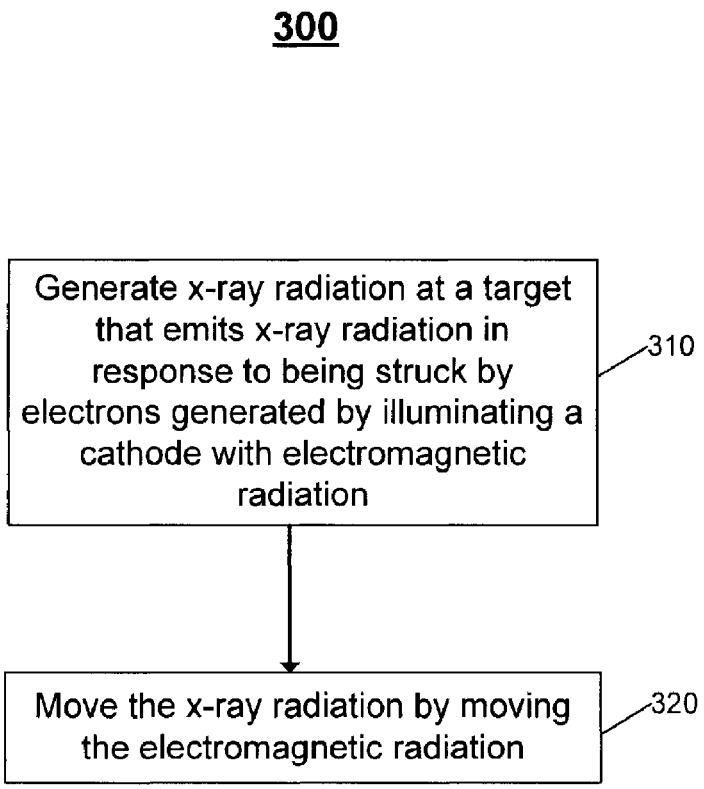
FIGS. 3 and 6 illustrate example processes for scanning an x-ray beam.

Referring to FIG. 3, an example process 300 for generating a moving x-ray beam is illustrated. The process 300 may be performed using a system such as the system 100 discussed above with respect to FIG. 1 or the system 200 discussed above with respect to FIG. 2A. X-ray radiation is generated at a target that emits x-ray radiation in response to being struck by electrons generated by illuminating a cathode with electromagnetic radiation (310). The cathode may be the cathode 125 or the cathode 225 discussed above with respect to FIGS. 1 and 2A, respectively. The target may be the target 135 or the target 230 discussed above with respect to FIGS. 1 and 2A, respectively, and the electromagnetic radiation may be the electromagnetic radiation 104 or 240 discussed above with respect to FIGS. 1 and 2A. The x-ray radiation is moved by moving the electromagnetic radiation (320). In some implementations, the electromagnetic radiation moves with respect to the cathode by moving a source of the electromagnetic radiation (such as the source 110 or the source 210). In some implementations, the x-ray radiation may be moved by directing the electromagnetic radiation toward a reflective surface (such as a reflective surface on the reflective element 140 or the reflective element 215) such that the electromagnetic radiation moves with respect to the cathode.

Figure 4A:
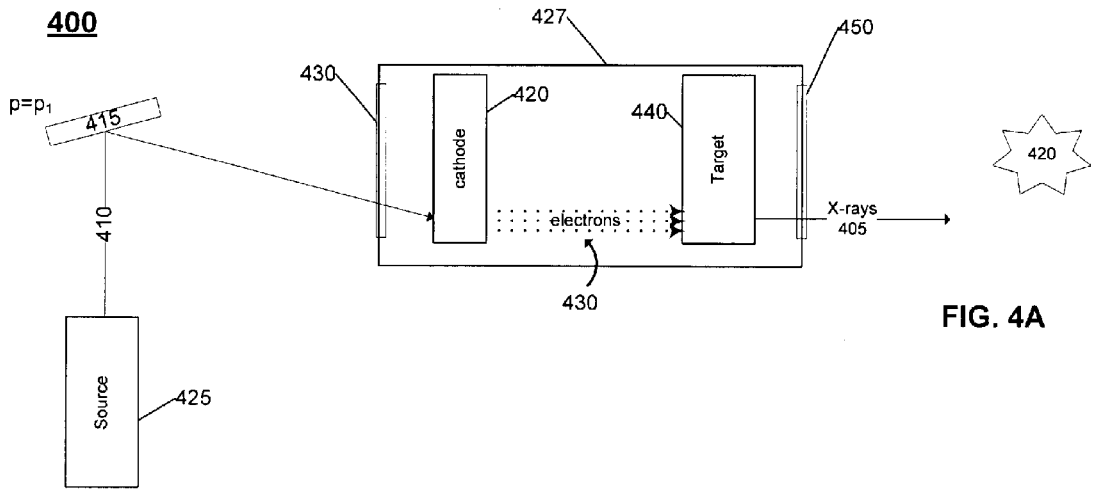
Figure 4B:
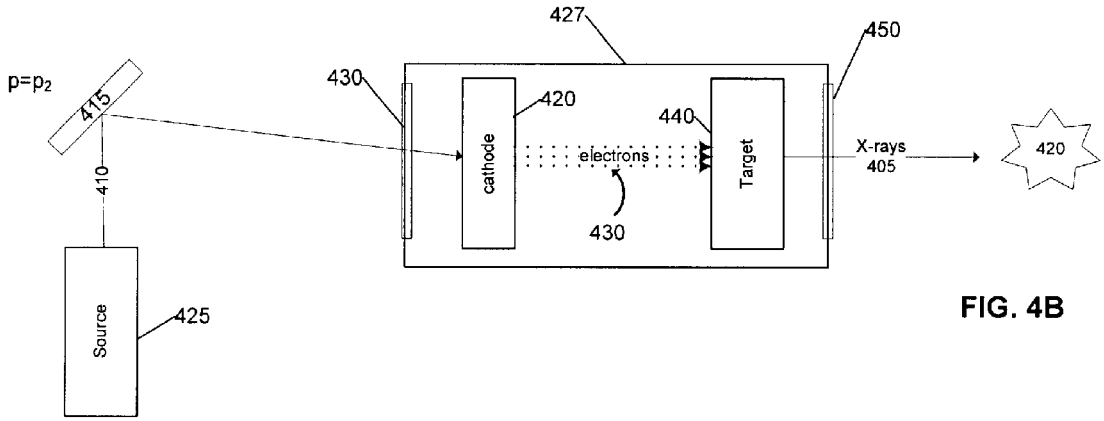
Figure 4C:
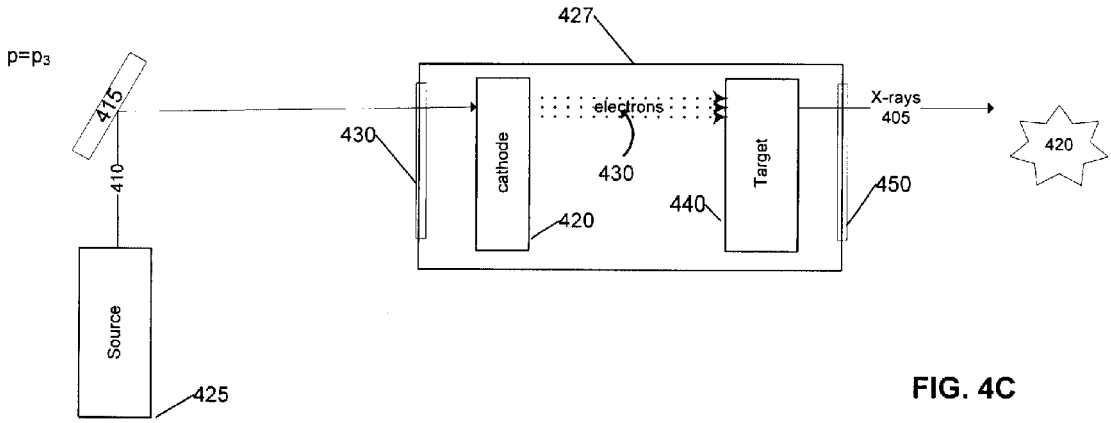

Referring to FIGS. 4A-4C, an example system 400 for moving x-ray radiation 405 by directing electromagnetic radiation 410 toward a reflective element 415 is shown. The example system 400 may be similar to the system 100 or the system 200 discussed above. The orientation of the reflective surface 415 is scanned from a position "$p_1$" (shown in FIG. 4A), through a position "$p_2$" (shown in FIG. 4B), to a position "$p_3$" in (shown in FIG. 4C) such that x-ray radiation 405 scans the sample 420. The electromagnetic radiation 410 is emitted by a source 425, which may be a source such as the source 110 or 210 discussed above. The electromagnetic radiation 410 propagates toward the reflective element 415 and is reflected from the reflective element 415 through a quartz window 430 into a vacuum chamber 427 and onto the cathode 420. The interaction between the cathode 420 and the electromagnetic radiation 410 generates an electron beam 430, which strikes a target 440 to produce the x-ray radiation 405. The x-ray radiation 405 exits the vacuum chamber 427 through a window 450 and illuminates the sample 420. As shown in FIGS. 4A-4C, scanning the electromagnetic radiation 410 by positioning the reflective element 415 causes the x-ray radiation 405 to scan across the sample 420 such that an image of the sample 420 may be generated. As discussed above with respect to FIGS. 2B and 2C, the reflective element 415 may be mounted on a mechanical mount such that the reflective element 415 may be positioned mechanically or a surface of the reflective element may be controllable through a voltage associated with the surface.

Figure 5:
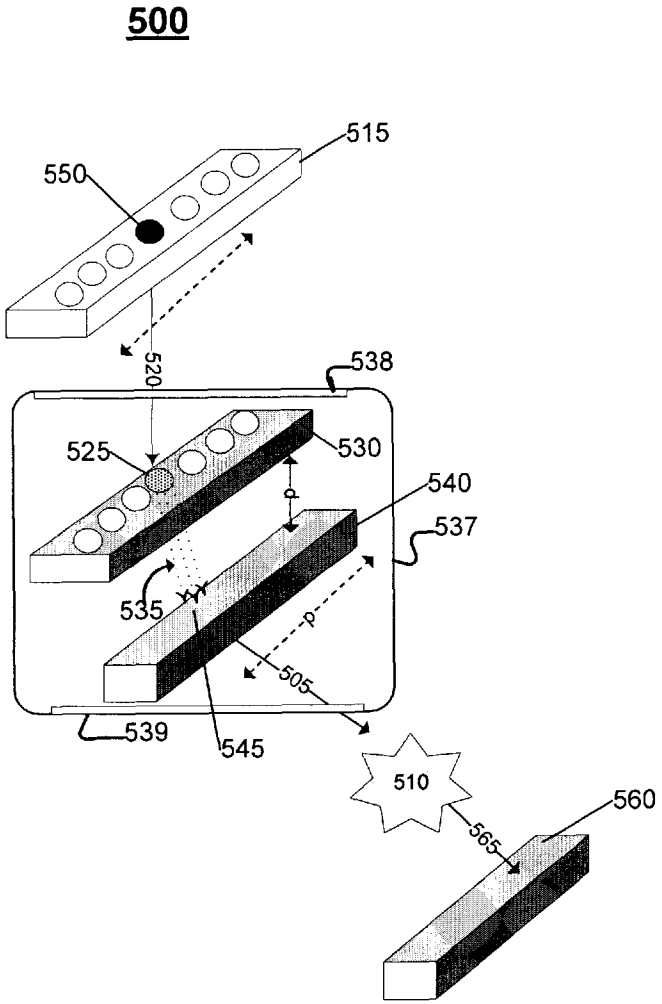

Referring to FIG. 5, an example system 500 for generating a moving x-ray beam 505 is illustrated. The x-ray beam 505 is scanned across a sample 510 along a path "p" by selectively activating sources included in an array of sources 515. Scanning the x-ray beam 505 by selectively activating sources included in the array of sources 515 may result in a system that is relatively simple to build, operate, and maintain. For example, selectively activating sources included in the array of sources 515 may include switching the sources included in the array of sources 515 ON and OFF. Thus, the electromagnetic radiation emitted from the sources included in the array of sources 515 is not necessarily directed or steered by a moving surface such as the reflective surface 140. Additionally, because the electromagnetic radiation emitted from the sources included in the array of sources 515, the array of sources 515 may be located within a few centimeters of the cathode 225, which may result in a more compact system.

The sources include in the array of sources 515 emit incoherent broadband radiation 520, the radiation 520 enters a vacuum chamber 537 through a quartz window 538, and the radiation 520 illuminates a cathode 525 included in a track 530. The sources included in the array of sources 515 may be any source that emits incoherent broadband radiation, such as tungsten lamps. Although the radiation 520 is broadband radiation, the radiation 520 may include sufficient radiation having wavelengths within the sensitive region of the cathode 525 such that illuminating the cathode with the radiation 520 produces an electron beam 535. For example, the cathode 525 may be a bialkali photocathode having a sensitive region from about 300 nm to 1200 nm and the sources included in the array of sources 515 may be 10,000 W incandescent lamps that include about 10 W of radiation in the sensitive region of the cathode 525. The interaction of the 10 W of radiation in the sensitive region included in the radiation 520 may be sufficient to generate the electron beam 535. The electron beam 535 is accelerated across a potential gap to a target 540 that produces the x-ray radiation 505 in response to being struck by the electron beam 535.

The electron beam 535 is emitted from the cathode 525 in the vicinity of the portion of the track 530 illuminated by the array of sources 515, and the x-ray radiation 505 is generated in the vicinity of the portion of the target 540 where the electron beam 535 strikes the target 540. Thus, the position of the x-ray radiation 505 is determined by the position of the activated source. As discussed in greater detail with respect to FIGS. 7A and 7B, the x-ray radiation 505 may be scanned along the sample 510 by selectively activating and deactivating the different sources included in the array of sources 515.

In the example shown in FIG. 5, the source 550 within the array of sources 515 is activated, and the position of the source 515 is aligned with the cathode 525 such that the cathode 525 is illuminated by the source 550 and the radiation 520 interacts with the cathode 525 to produce the electron beam 535. The electron beam 535 strikes the target 540 at a portion 545 of the target 540 and produces the x-ray radiation 505 in the vicinity of the portion 545. The x-ray radiation 505 exits the vacuum chamber 537 through a window 539 and illuminates the sample 510. A detector 560 detects transmitted x-rays 565 that may be used to generate an image of the sample 510.

Figure 6:
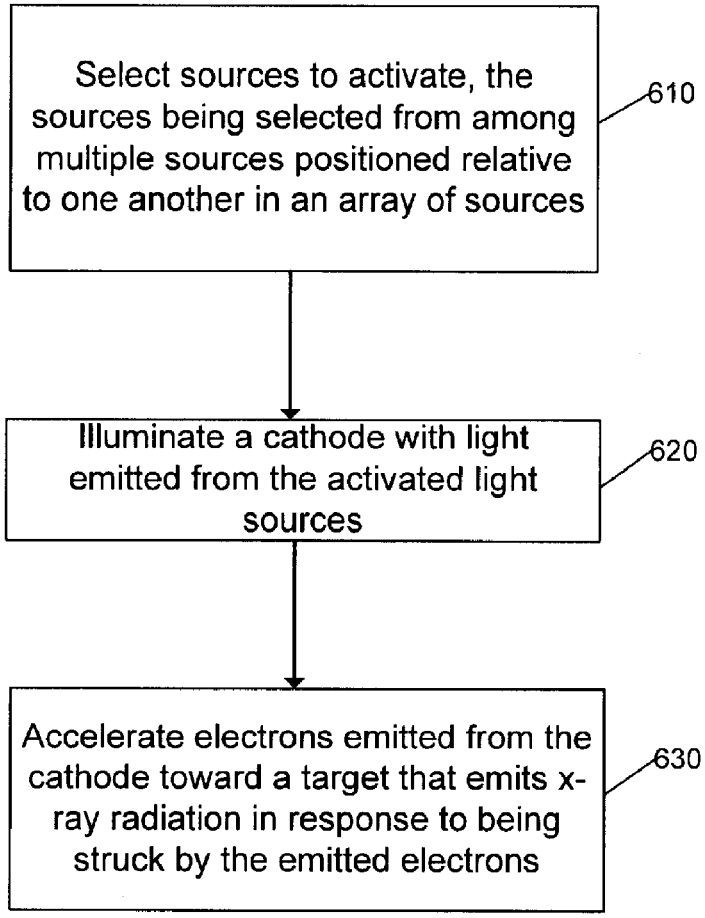

Referring to FIG. 6, an example process 600 for generating a scanning x-ray beam is illustrated. The process 600 may be performed by a system such as the system 500 discussed above with respect to FIG. 5. Sources to activate are selected (610). The sources to activate are selected from among multiple sources positioned relative to one another in an array of sources. The array of sources may be an array such as the array 515. In some implementations, one source is selected from among the sources included in the array of sources 515; however, more than one source may be selected to be activated. The selected sources may be neighboring sources or the selected sources may be separated from each other and have non-selected sources between selected sources. A cathode is illuminated with light emitted from the activated light sources (620). As discussed above, the position of the radiation emitted from the array of sources 515 relative to the track 530 determines the position of the x-ray radiation 505. Thus, the sources to activate may be selected in (610) based on the position of the sources relative to the cathode. The interaction between the radiation emitted from the selected sources and the cathode results in the emission of electrons from the cathode. The electrons are accelerated toward a target that emits x-ray radiation in response to being struck by the electrons emitted from the cathode (630). The target may be the target 540 discussed above with respect to FIG. 5 or the target 230 discussed above with respect to FIG. 2.

Figure 7A:
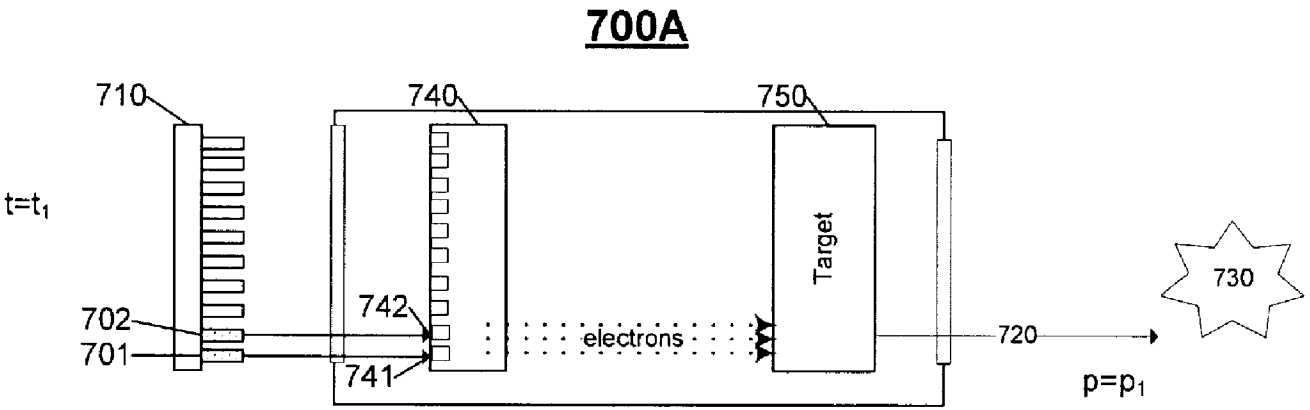
Figure 7B:
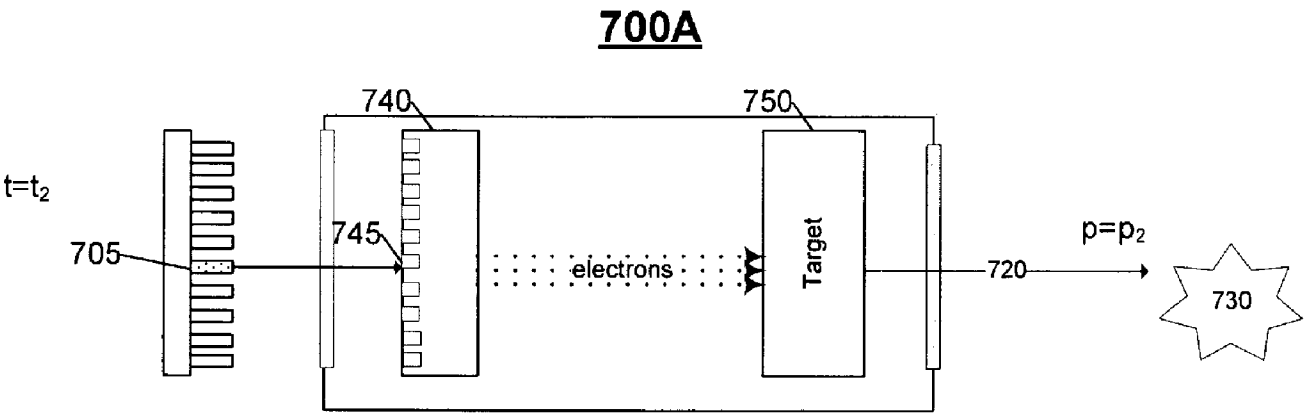
Figure 7C:
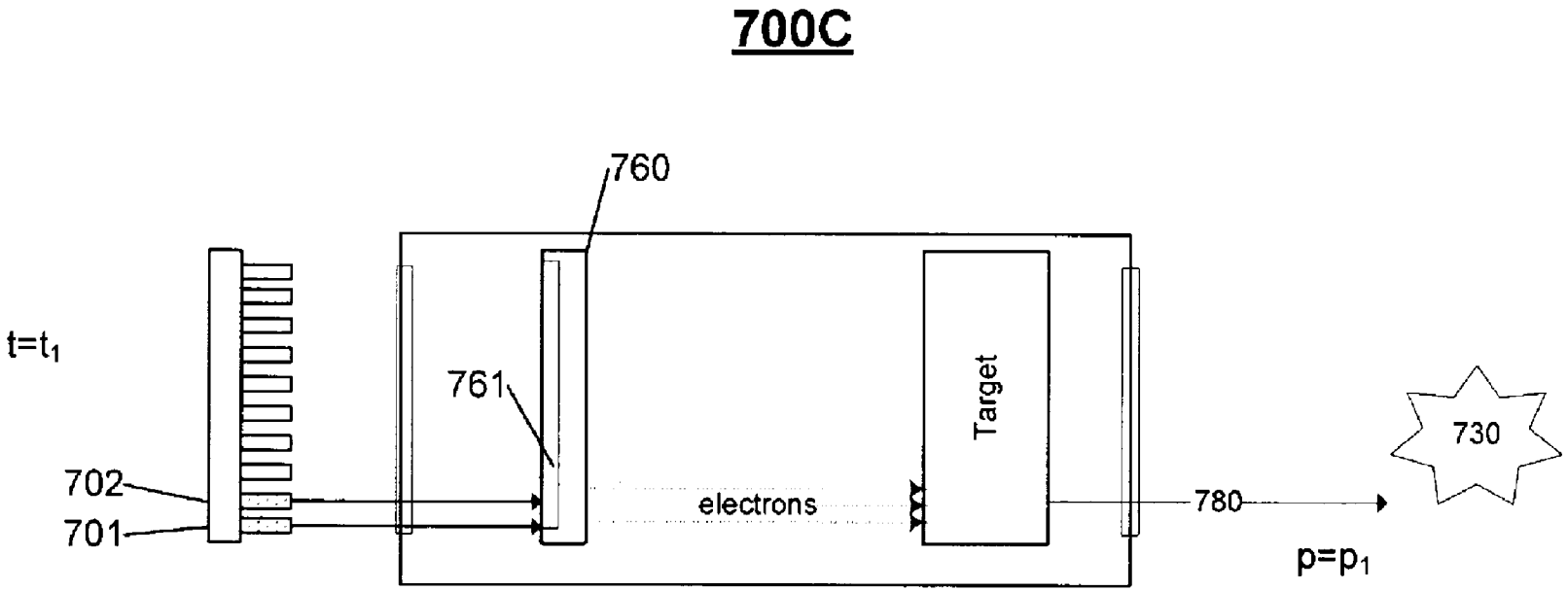

Referring to FIGS. 7A and 7B, an example of moving an x-ray beam by selectively activating sources included in an array of sources is illustrated. In particular, FIG. 7A shows a system 700A at a time "$t=t_1$," in which sources 701 and 702 of an array of sources 710 are activated and emit electromagnetic radiation, and FIG. 7B shows the system 700A at a time "$t=t_2$," in which source 705 is activated and sources 701 and 702 have been deactivated. Activation of the sources 701 and 701 results in an x-ray beam 720 at a position "$p=p_1$." As shown in FIG. 7B, at time "$t=t_2$," the x-ray beam 720 has moved to a position "$p=p_2$" as a result of the sources 701 and 702 being deactivated and the source 705 being activated. In the example shown in FIG. 7A, the sources 701 and 702 are activated and illuminate cells 741 and 742 of a cathode 740 with radiation sufficient to produce electrons. In the example shown in FIG. 7B, the source 705 is activated and the cell 745 is illuminated with electromagnetic radiation sufficient to produce electrons. In both examples, the electrons are accelerated toward a target 750, and the x-ray beam 720 is produced by the electrons striking the target 750, and the position of the x-ray beam 720 is determined by the positions of the sources 701 and 702. Thus, the x-ray beam 720 may be scanned or positioned along the sample 730 by selectively activating sources included in the array of sources 710. In the examples shown in FIGS. 7A and 7B, the cathode 740 includes multiple cathode cells (such as the cathode cells 741, 742, and 745). However, in other examples, such as the example system 700C shown in FIG. 7C, a cathode 760 may be a single piece of material 761. The portion of the material 761 that is illuminated determines the position of x-ray radiation 780. In the example shown in FIG. 7C, the sources 701 and 702 are activated, and the x-ray radiation 780 has a position similar to that shown in FIG. 7A.

The array of sources 710 may be similar to the array of sources 515 discussed above with respect to FIG. 5. In one example, in some implementations, the array of sources 515 may be a one-dimensional, linear array of sources. In a second example, the array of sources 515 may be a two-dimensional array of sources.

Figure 8:
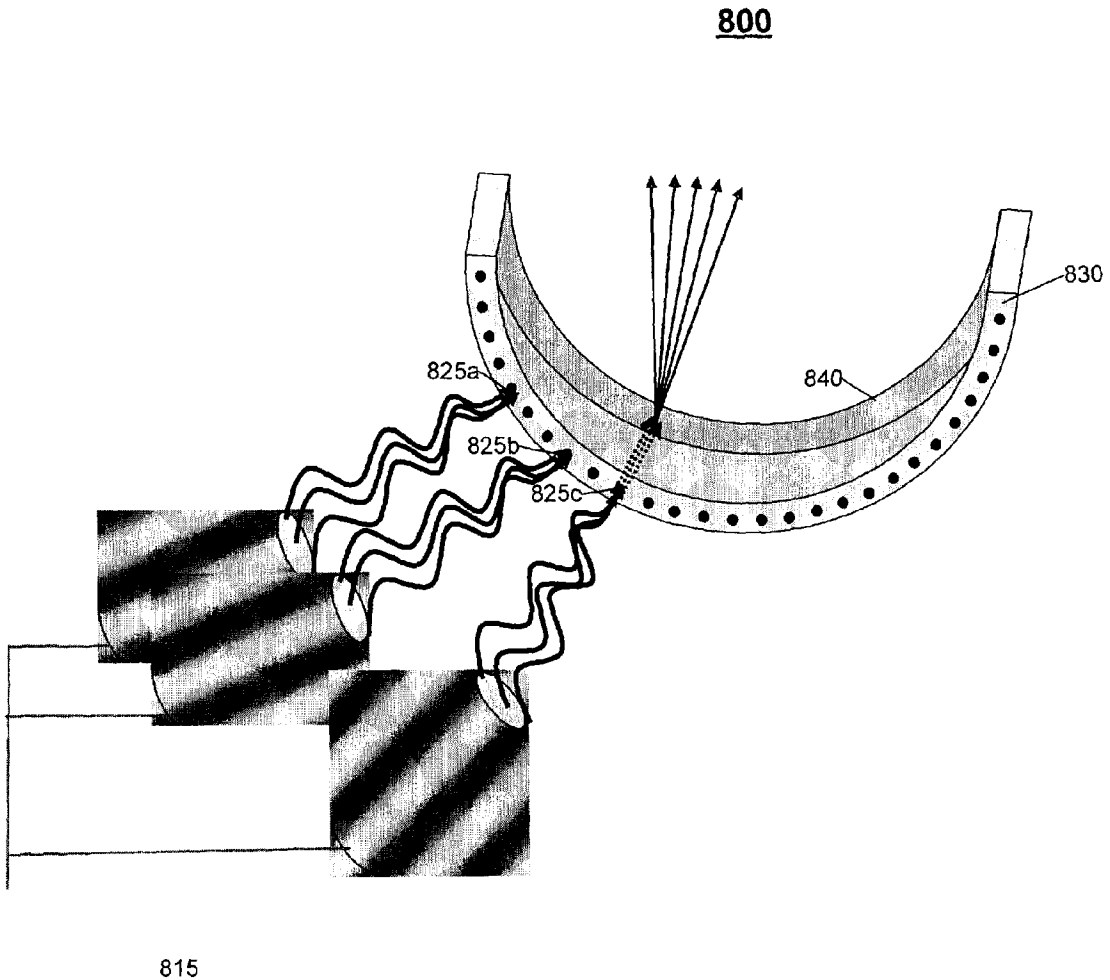

Referring to FIG. 8, a system 800 that generates a moving x-ray beam is illustrated. The system 800 is similar to the system 500 discussed above with respect to FIG. 5. However, the system 800 includes a track 830 having discrete cathode cells arranged on a curved surface 831 of the track 830. The system 800 includes an array of sources 815, the track 830, and a target 840. The array of sources 815 may include broadband, incoherent sources arranged in a pattern that matches the curved surface 831 such that the discrete cathode cells arranged on the track 830 may be selectively illuminated by the sources included in the array of sources 815. In the example shown, the array of sources 815 includes three sources, and the sources are illuminating cathodes 825*a*, 825*b*, and 825*c*. In other examples, the array of sources 815 may include more or fewer sources. In the example shown in FIG. 8, the track 830 includes discrete cathode cells, however in other implementations, the cathode may be a single piece of photosensitive material that covers all or part of the curved surface 831.

Other implementations are within the scope of the following claims. For example, the track 127 and the target 135 may be sized according to an application of the system 100. In some implementations, the track and the target 135 may be 1-meter long for a system that is used to image samples, or portions of samples, that are less than a meter long in one dimension. In some implementations, the track 127 may have a curved surface, and the curved surface may have a degree of curvature as indicated by the application. In some implementations, the track 127 may have an irregular surface. In some implementations, the reflective element 140 may be a deformable mirror.

What is claimed is:

1. A system comprising:

a light-emitting diode that emits incoherent light;

a cathode that emits electrons in response to being illuminated by the incoherent light;

an accelerating element that accelerates the emitted electrons from the cathode toward a target that generates localized x-ray radiation in response to being struck by the accelerated electrons;

a surface that directs the incoherent light from the light-emitting diode toward the cathode; and a mechanism coupled to the surface that moves the incoherent light emitted from the light-emitting diode relative to the cathode such that a position of the localized x-ray radiation corresponds to a position of the incoherent light emitted from the light-emitting diode.

2. The system of claim 1, wherein:

the surface that directs the incoherent light from the light-emitting diode toward the cathode comprises a reflective element configured to reflect the incoherent light emitted from the light-emitting diode toward a portion of the cathode determined by an orientation of the reflective element relative to a direction of propagation of the incoherent light, and the mechanism coupled to the surface comprises an actuator coupled to the reflective element that controls the orientation of the reflective element.

3. The system of claim 2, wherein the reflective element comprises a reflective surface, and the actuator comprises a voltage at the reflective surface.

4. The system of claim 2, wherein the reflective element comprises a reflective surface, and the actuator comprises a movable mounting device that controls the orientation of the reflective surface.

5. The system of claim 2, wherein the reflective element comprises a mirror.

6. The system of claim 1, further comprising:

a vacuum chamber enclosing the cathode and the target;

a first window that transmits the incoherent light emitted from the light-emitting diode into the vacuum chamber; and a second window that transmits the localized x-ray radiation from the vacuum chamber.

7. The system of claim 1, wherein the cathode comprises more than one cathode arranged in a linear array along a track.

8. The system of claim 7, wherein the track comprises a flat surface.

9. The system of claim 1, wherein the cathode comprises a transmission cathode.

10. The system of claim 1, wherein:

the cathode emits electrons in response to being illuminated by incoherent light included in a band of wavelengths, and applying a voltage to the cathode determines the band of wavelengths.

11. The system of claim 1, further comprising a detector.

12. The system of claim 1, wherein the accelerating element comprises a potential between the cathode and the target, the potential being relatively greater at the target as compared to the cathode.

13. The system of claim 1, wherein the accelerating element comprises multiple potentials between the cathode and the target.

14. The system of claim 1, wherein the cathode comprises a photocathode.

15. A method comprising:

generating x-ray radiation at a target that emits x-ray radiation in response to being struck by accelerated electrons, the electrons being emitted by a cathode that emits electrons in response to being illuminated by incoherent light emitted from a light-emitting diode; and moving the x-ray radiation by orienting a surface that directs the incoherent light from the light-emitting diode toward the cathode.

16. The method of claim 15, wherein moving the x-ray radiation by orienting a surface that directs the incoherent light emitted from the light-emitting diode toward the cathode comprises directing the incoherent light from the light-emitting diode toward a reflective surface and rotating the reflective surface such that the incoherent light moves with respect to the cathode.

17. The method of claim 16, wherein a voltage determines an orientation of the reflective surface.

18. The method of claim 15, further comprising moving the light-emitting diode relative to the cathode.

19. The method of 16 further comprising:

illuminating a sample with the x-ray radiation;

detecting x-ray radiation transmitted by the sample; and generating an image of the sample based on the detected x-ray radiation.

20. A system comprising:

an array of sources that emit incoherent light, the sources in the array being configured to be selectively activated to emit the light;

a cathode that emits electrons in response to being illuminated by light emitted from an activated source included in the array; and an accelerating element that accelerates the emitted electrons toward a target that generates x-ray radiation in response to being struck by the accelerated electrons, the x-ray radiation having a location relative to the target that is determined by a position of the activated source.

21. The system of claim 20, wherein the array of sources comprises multiple incandescent light sources.

22. The system of claim 20, wherein the array comprises a linear array.

23. The system of claim 20, wherein the incoherent light comprises broadband incoherent light.

24. A method comprising:

selecting an incoherent light source to activate, the incoherent light source being selected from among multiple incoherent light sources positioned relative to one another in an array of sources;

activating the selected light source;

illuminating a cathode with light emitted from the activated light source; and accelerating electrons emitted from the cathode toward a target that emits x-ray radiation in response to being struck by the emitted electrons, the emitted x-ray radiation having a position relative to the cathode and the target that is determined by a position of the activated light sources within the array.

25. The system of claim 1, wherein a power of the incoherent light is determined by independently of an optical element disposed between the source and the mechanism.

26. The system of claim 1, wherein the light-emitting diode emits broadband incoherent light.

27. The system of claim 1, wherein the light-emitting diode has a power between 10 and 1000 Watts.

28. The system of claim 21, wherein the incandescent light sources comprise incandescent lamps emitting up to 10,000 Watts, the cathode produces electrons only in response to being illuminated with light having a wavelength within a spectral band between 300-nm and 500-nm, and the lamps produce about 10-Watts of radiation within the spectral band.

29. The system of claim 20, wherein the array of sources comprises a light-emitting diode.

30. The system of claim 20, wherein the cathode that emits electrons in response to being illuminated by light emitted from an activated source included in the array is configured to emit electrons in a single uniform direction relative to the cathode.

31. The system of claim 20, wherein the array of sources is located in close proximity to the cathode.

32. The system of claim 31, wherein the array of sources is no more than a centimeter from the cathode.

* * * * *

UNITED STATES PATENT AND TRADEMARK OFFICE

CERTIFICATE OF CORRECTION

PATENT NO. : 7,864,924 B2
APPLICATION NO. : 12/138668
DATED : January 4, 2011
INVENTOR(S) : Ziskin et al.

It is certified that error appears in the above-identified patent and that said Letters Patent is hereby corrected as shown below:

In column 12, line 63, in claim 19, delete "16" and insert -- claim 16 --, therefor.

Signed and Sealed this
Eighth Day of March, 2011

David J. Kappos

David J. Kappos
*Director of the United States Patent and Trademark Office*